United States Patent [19]

Kageyama

[11] Patent Number: 4,620,811

[45] Date of Patent: Nov. 4, 1986

[54] MECHANICAL PENCIL

[75] Inventor: Hidehei Kageyama, Kawagoe, Japan

[73] Assignee: Kotobuki & Co., Ltd., Kyoto, Japan

[21] Appl. No.: 640,999

[22] Filed: Aug. 14, 1984

[30] Foreign Application Priority Data

Jan. 26, 1984 [JP] Japan ..... 59-9369[U]
Mar. 16, 1984 [JP] Japan ..... 59-37663[U]

[51] Int. Cl.[4] ..... B43K 21/16
[52] U.S. Cl. ..... 401/65; 401/214
[58] Field of Search ..... 401/53, 54, 65, 67, 401/78, 94, 214, 85

[56] References Cited

U.S. PATENT DOCUMENTS

| | | | |
|---|---|---|---|
| 3,379,490 | 4/1968 | Schwartzman | 401/214 |
| 3,850,531 | 11/1974 | Ackermann | 401/53 X |
| 3,917,418 | 11/1975 | Lanoie | 401/78 X |
| 4,003,664 | 1/1977 | Butka | 401/67 |
| 4,149,813 | 4/1979 | Katz et al. | 401/65 |
| 4,371,277 | 2/1983 | Kageyama | 401/65 X |
| 4,382,706 | 5/1983 | Hashimoto et al. | 401/67 |

FOREIGN PATENT DOCUMENTS

| | | | |
|---|---|---|---|
| 1090004 | 3/1955 | France | 401/214 |
| 55-5350 | 2/1980 | Japan | 401/67 |
| 1043793 | 9/1966 | United Kingdom | 401/214 |
| 8300309 | 2/1983 | PCT Int'l. Appl | 401/85 |

*Primary Examiner*—Richard J. Apley
*Assistant Examiner*—Robert W. Bahr
*Attorney, Agent, or Firm*—Sherman & Shalloway

[57] ABSTRACT

A mechanical pencil reduced in the number of the component parts and facilitating the assembling work, comprising an outer cylinder, a replaceable lead cartridge, a tip member including a cushion member capable of contracting according to writing pressure that works on the lead so that the lead is retracted into the tip member when an excessive writing pressure works on the lead to prevent the breakage of the lead, and a lead feeding mechanism which is constructed within the tip member prior to the connection of the tip member to the outer cylinder.

1 Claim, 56 Drawing Figures

FIG. 17 (a)
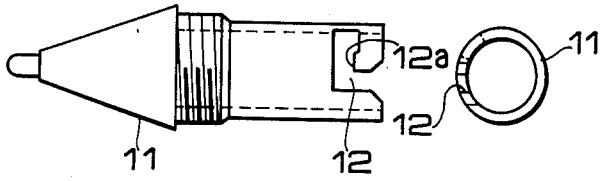
FIG. 17 (b)
FIG. 18 (a)
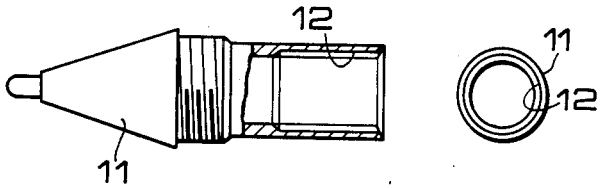
FIG. 18 (b)
FIG. 19
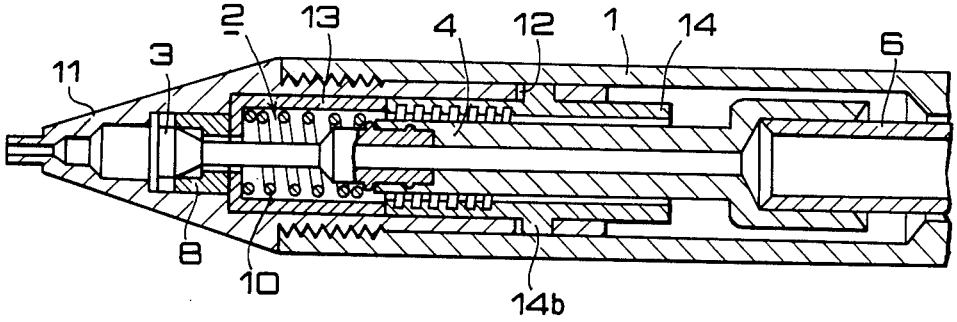
FIG. 20 (a) FIG. 20 (b) FIG. 20 (c)
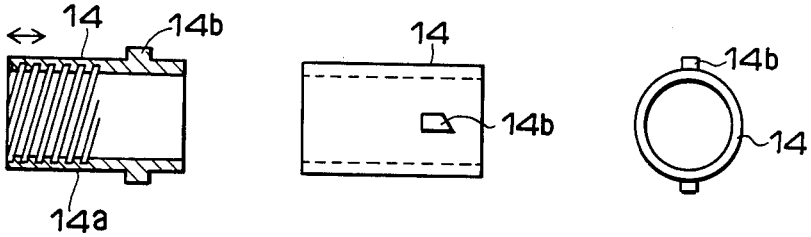

FIG. 21 (a)
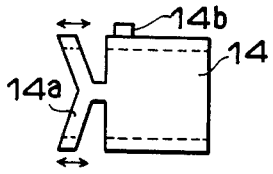
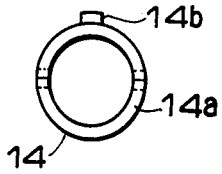
FIG. 21 (b)
FIG. 22 (a)
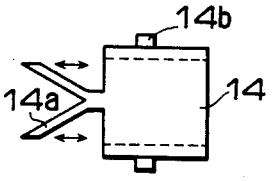
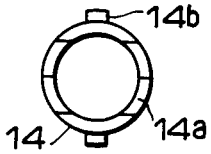
FIG. 22 (b)
FIG. 23 (a)
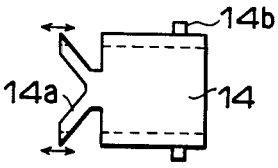
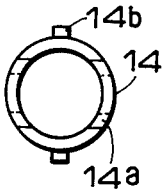
FIG. 23 (b)
FIG. 24 (a)
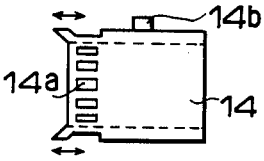
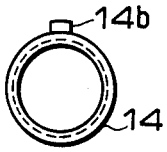
FIG. 24 (b)
FIG. 25 (a)
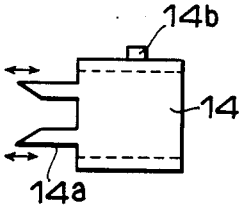
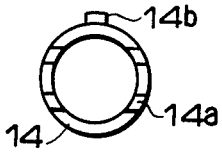
FIG. 25 (b)
FIG. 26 (a)
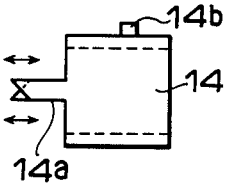
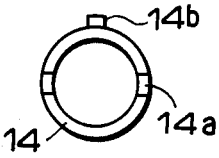
FIG. 26 (b)
FIG. 27 (a)
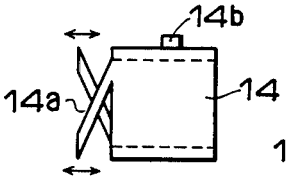
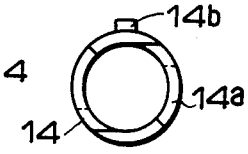
FIG. 27 (b)

MECHANICAL PENCIL

BACKGROUND OF THE INVENTION

1. Field of the Invention

The present invention relates to a mechanical pencil and more particularly to a mechanical pencil having a sleeve capable of writing pressure regulation and a lead cartridge functioning as a lead pipe.

2. Description of the Prior Art

In writing with a conventional mechanical pencil, it is necessary to take out leads from a lead case and replenish the mechanical pencil with leads by putting leads one by one into the lead pipe, when the lead of the mechanical pencil is exhausted. Such a lead refilling work is troublesome and soils the fingers.

A mechanical pencil having an excessive writing pressure absorbing function needs a second spring for excessive writing pressure absorption in addition to a first spring for projecting a lead, and hence the construction is complicated and the assembling work is troublesome. The applicant of the present invention proposed a mechanical pencil having a sleeve capable of regulating writing pressure, in Utility Model Application No. Sho 57-67850, to overcome the disadvantages of the conventional mechanical pencil.

SUMMARY OF THE INVENTION

The present invention has been made through the elimination of the above-mentioned disadvantages of the conventional mechanical pencil and the improvement of the invention of the prior application. It is an object of the present invention to provide a mechanical pencil of a simple construction consisting of a reduced number of parts, which enables refilling leads without soiling the fingers by replacing the lead cartridge.

Other objects and features of the present invention will become apparent from the following detailed description thereof taken in connection with the accompanying drawings.

BRIEF DESCRIPTION OF THE DRAWINGS

FIGS. 14(*b*), 15(*b*), 16(*b*), 17(*b*) and 18(*b*) are side elevations of the tip members of FIGS. 14(*a*), 15(*a*), 16(*a*), 17(*a*) and 18(*a*) respectively;

FIG. 19 is a longitudinal sectional view of a fourth embodiment of the present invention;

FIGS. 20(*a*), 20(*b*) and 20(*c*) are explanetory views of a stopper;

FIGS. 21(*a*), 22(*a*), 23(*a*), 24(*a*), 25(*a*), 26(*a*) and 27(*a*) are front elevations of stoppers:

FIGS. 21(*b*), 22(*b*), 23(*b*), 24(*b*), 25(*b*), 26(*b*) and 27(*b*) are side elevations of the stoppers of FIGS. 21(*a*), 22(*a*), 23(*a*), 24(*a*), 25(*a*), 26(*a*) and 27(*a*) respectively;

DETAILED DESCRIPTION OF THE INVENTION

Figure 1:
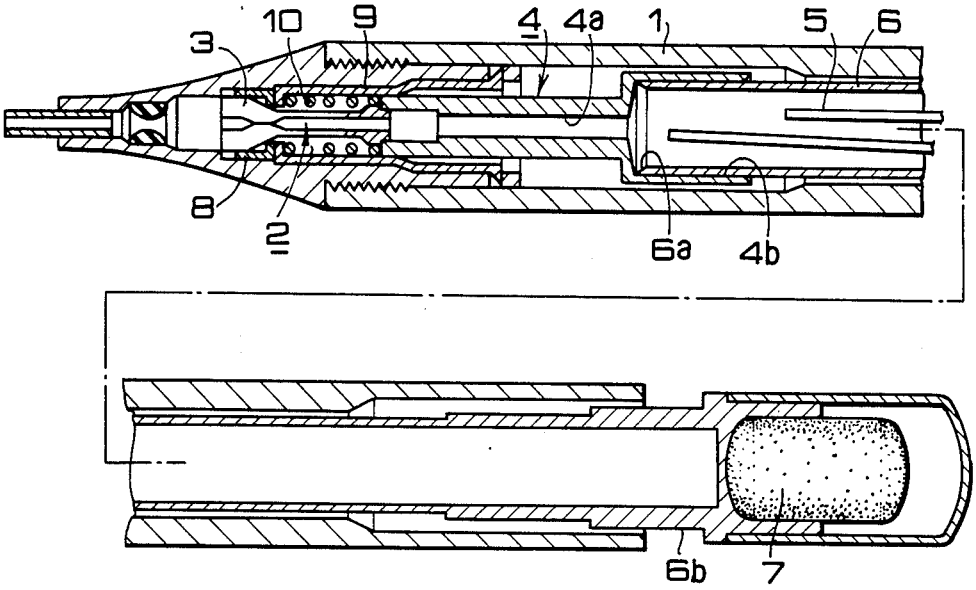
FIG. 1 is a sectional view of a preferred embodiment of the present invention.

As shown in FIG. 1 in a longitudinal sectional view, a lead guide 4 is fitted on the rear end of a lead chuck 3 of a lead feeding mechanism 2 disposed within an outer cylinder 1.

The lead guide 4 functions to feed leads 5 one by one to the lead chuck 3. A lead feed bore 4*a* capable of passing a single lead 5 and a cartridge receiving bore 4*b* capable of closely receiving a lead cartridge of an outside diameter approximately the same as the inside diameter of the outer cylinder 1 are formed continuously through the lead guide 4. A lead cartridge 6 is fitted detachably in the lead cartridge receiving bore 4*b*.

As illustrated in FIG. 1, the lead cartridge 6 contains a plurality of leads 5 and is provided at the rear end thereof with a piece of erasing rubber. Usually, the lead cartridge 6 containing a plurality of leads is available in the market. The lead cartridge 6 is formed so that the outside diameter thereof is approximately the same as the inside diameter of the lead cartridge receiving bore 4*b* and the inside diameter of the outer cylinder 1. Preferably, the front extremity of the lead cartridge 6 is tapered to form a lead guiding section 6*a*. The cartridge 6 is adpated to be pulled out from the lead guide 4 when an appropriate pulling force is applied to the rear end thereof.

The lead feeding mechanism 2 consists of the lead chuck 3, a chuck clamping pipe 8 receiving the free end of the chuck 3 therethrough, a cushion sleeve 9 disposed in contact with the rear end of the chuck clamping pipe 8 to regulate the retracting movement of the chuck clamping pipe 8 and a first spring 10 for lead feeding motion provided resiliently between the cartridge 6 and the cushion sleeve 9.

Figure 2:
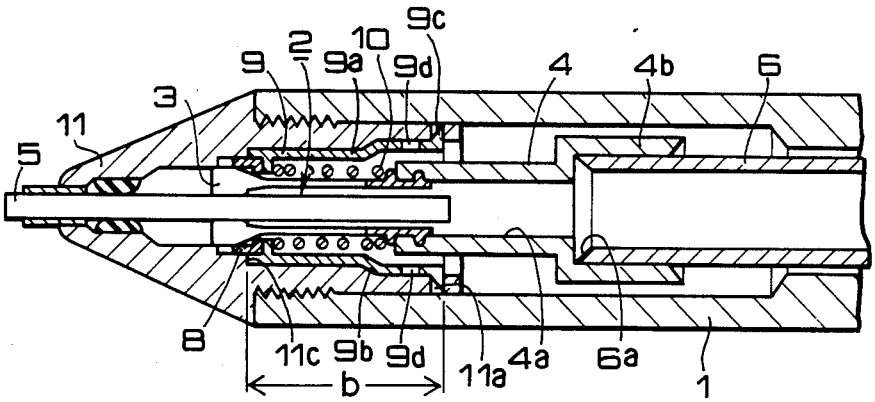
FIG. 2 is a longitudinal sectional view of the essential part of FIG. 1.
Figure 3:
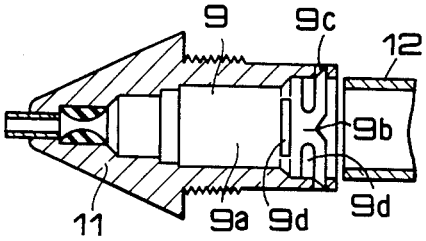
FIG. 3 is a partial sectional view of the essential part of FIG. 2.

The cushion sleeve 9 is an essential member of the mechanical pencil of the present invention and is formed of an elastically deformable resilient material such as Duracon. As illustrated in FIGS. 2 and 3, the cushion sleeve 9 consists integrally of a sleeve body 9*a* and an axially extendable and contractible cushioning part 9*b* and the stopping projections 9*c* engage the stopping holes 11*a* of a tip member 11.

A plurality of slits 9*d* are formed in the cushioning part 9*b* as shown in FIGS. 2 and 3, to make the stopping projections 9*c* engage the stopping holes 11*a* surely and to provide writing pressure regulating effect. The outside diameter of the cushioning part 9*b* is greater than the outside diameter of the sleeve body 9*a*. In case an excessive writing pressure is applied to the lead 5 during writing with the mechanical pencil, the cushioning part 9*b* of the cushion sleeve 9 contracts axially to retract the lead 5 into the outer cylinder 1. Accordingly, it is not necessary to provide a second spring, which is necessary in the conventional mechanical pencil to bias the sleeve frontward and, as will be described later, assembling work and the component parts are simplified significantly.

Figure 4:
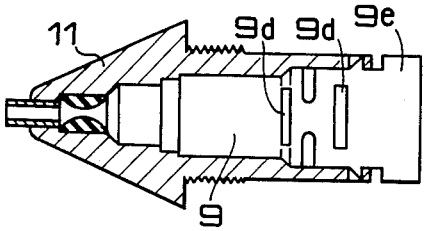
FIG. 4 is a partial longitudinal sectional view of the essential part of a second embodiment of the present invention.
Figure 5A:
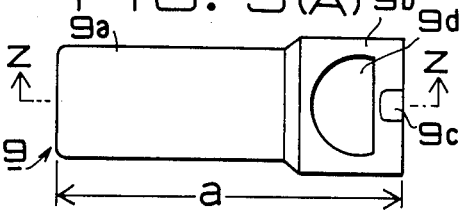
FIGS. 5(A), 6(A), 7(A) and 8(A) are plan views of various forms of a cushion sleeve embodying the present invention.
Figure 5B:
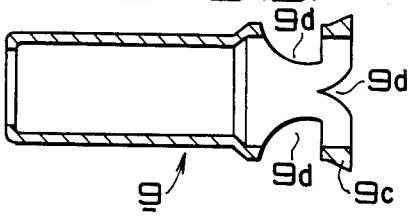
FIGS. 5(B), 6(B), 7(B) and 8(B) are longitudinal sectional views taken on line Z—Z of FIGS. 5(A), 6(A), 7(A) and 8(A) respectively.
Figure 6A:
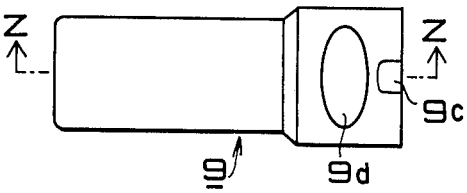
Figure 6B:
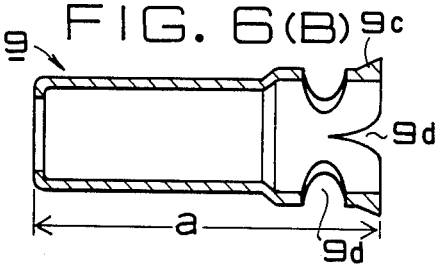
Figure 7A:
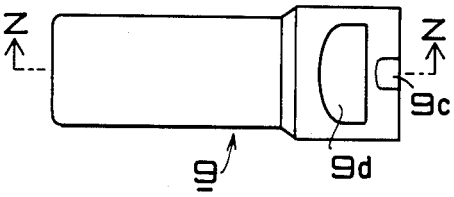
Figure 7B:
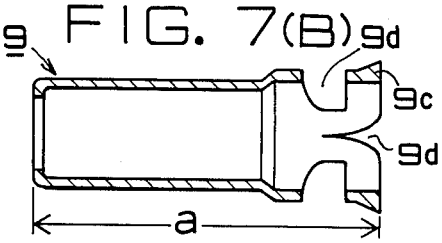
Figure 8A:
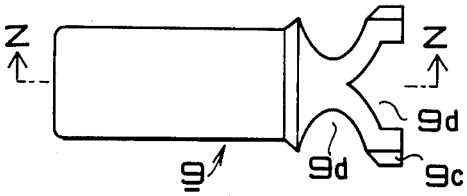
Figure 8B:
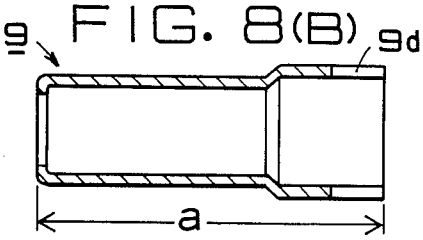

FIG. 4 shows another embodiment of the cushion sleeve 9. In this embodiment, the rear end of the coushioning part 9*b* is extended so as to project from the tip member 1 to form a nipping part 9*e*. The cushioning sleeve 9 can be attached to the tip member 11 in place by nipping the nipping part 9*e* without using a FIG. 12 (FIG. 3).

FIGS. 5 to 8 show other embodiments of the cushioning sleeve 9. In these embodiments, the form and the structure of the slits 9*d* are modified to facilitate attaching the cushioning sleeve 9 to the tip member 11 and to axial extension and contraction of the cushioning part 9*b*. The stopping projections 9*c* and the slits 9*d* may be of any form only if the cushion sleeve 9 can be attached to the tip member 11 surely and the cushioning part 9*b* is effectively deformable.

Figure 9:
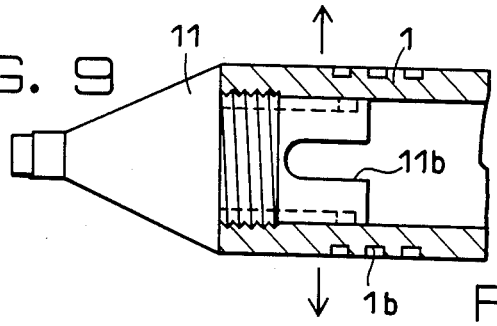
FIG. 9 is a partial longitudinal sectional view of the essential part of a third embodiment of the present invention.

Axial slits 11*b* are formed in the tip member 11 which holds the cushion sleeve 9 as shown in FIG. 9, to facilitate attaching the cushion sleeve 9 to the tip member 11 and assembling the lead feeding mechanism 2, and hence the tip member 11 can be opened widely as indicated by the arrows. Since the tip member 11 can not be opened over the inside diameter of the outer cylinder 1 after the tip member 9 has been joined to the outer cylinder 1, the cushion sleeve 9 can be held securely by the tip member 11. When the cushion sleeve 9 is deformable, it is not necessary to form the slits 11*b* in the tip member 11.

Figure 10:
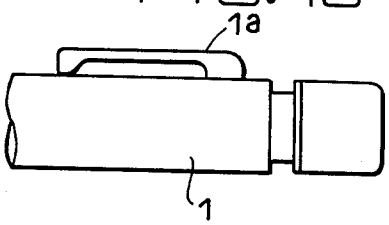
FIG. 10 is a partial plan view of an outer cylinder according to the present invention.

FIG. 10 shows another embodiment of the outer cylinder 1, in which a pencil clip 1*a* is formed integrally with the outer cylinder 1.

Figure 11:
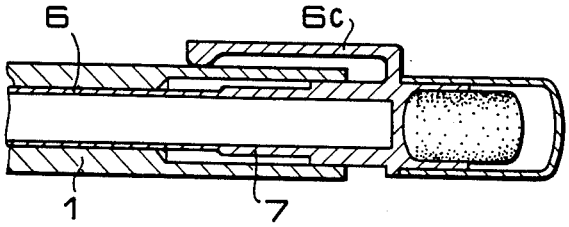
FIG. 11 is a partial longitudinal sectional view of another embodiment of an outer cylinder.

The outer cylinder 1 can be formed effectively by extrusion and the outer cylinder 1 may be provided with grooves 1*b* as shown in FIG. 9 to prevent the mechanical pencil from slipping off the fingers. FIG. 11 shows an embodiment of the lead cartridge 6, in which a pencil clip 6*c* is formed integrally with the lead cartridge 6 at the rear projection 6*b*.

The functions of the mechanical pencil according to the present invention and assembling procedures for assembling the same will be described hereinafter.

Since the cushioning part 9*b* is an integral part of the cushion sleeve 9, the cushioning part 9*b* can be fitted efficiently to the outer cylinder 1 and a second spring for absorbing excessive writing pressure is unnecessary. Consequently, the number of parts and the manufacturing cost of the mechanical pencil are reduced.

Furthermore, the mechanical pencil is assembled completely simply by inserting the assembly of the tip member 11 and the lead feeding mechanism 2 through the front end into the outer cylinder 1. When the outer cylinder 1 is formed through extrusion, in particular, according to the above-mentioned prior application (Utility Model Application No. Sho 57-67850), a cushion sleeve stopping hole needs to be formed after forming the outer cylinder and the cushion sleeve stopping hole shows disadvantageously on the outer surface of the outer cylinder, whereas, according to the present invention, no hole needs to be formed and the cushion sleeve stopping hole does not show on the outer surface of the outer cylinder, therefore, the outer cylinder can simply be formed through extrusion and the outer cylinder has good appearance.

Furthermore, since the length a from the front end of the cushion sleeve 9 to the stopping projection 9*c* (FIGS. 5 to 8) is greater than the length b (FIG. 2) from the shoulder 11*c* to the stopping hole 11*a* of the tip member 11 ($a>b$) and the cushion sleeve is elastic, the cushion sleeve 9 does not come off easily from the tip member 11 after the cushion sleeve 9 has once been attached to the tip member 11. Still further, since axial slits 11*b* are formed in the tip member 11 and the cushion sleeve 9 has the nipping part 9*e* as shown in FIG. 4, the tip member 11 and the cushion sleeve 9 can easily be assembled without using the FIG. 12 as shown in FIG. 3.

After the mechanical pencil has thus been assembled, the cushioning part 9*b* of a spring constant which is smaller than the spring constant of the first spring 10 for lead feeding motion functions as a spring for writing pressure regulation in addition to the first spring 10. Therefore, when an excessive writing pressure is applied to the lead 5, the cushioning part 9*b* contracts so that the lead 5 is allowed to retract into the outer cylinder 1. Thus the breakage of the lead 5 can effectively be prevented.

Figure 12:
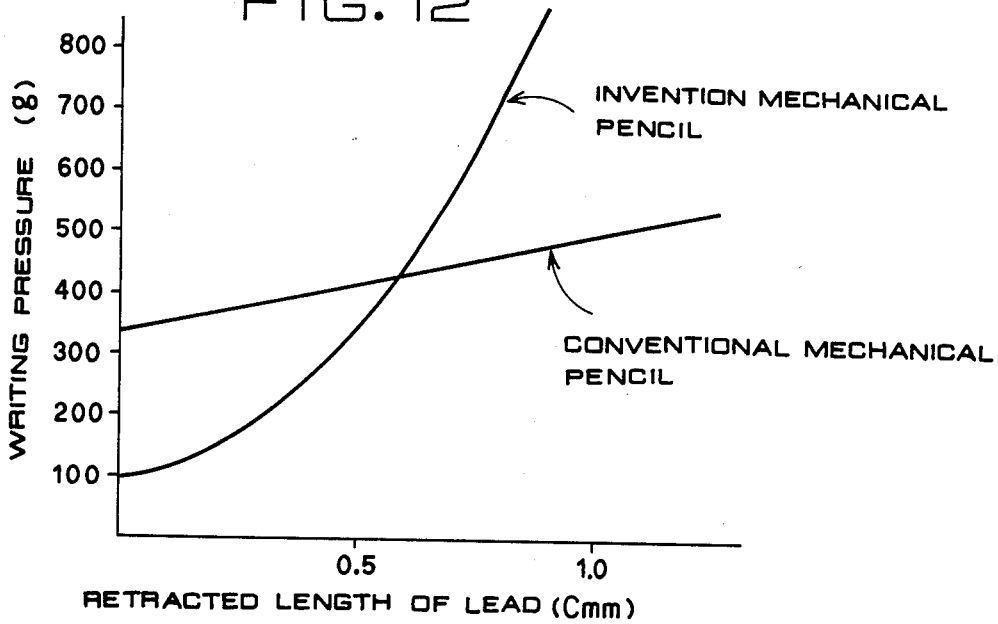
FIG. 12 is a diagram showing the relation between the retraction of the lead and writing pressure.

As shown in FIG. 12, the relationship of the amount of contraction of the cushion sleeve 9 to writing pressure is not as linear as of an ordinary spring. The cushion sleeve contracts even when a small writing pressure is applied to the lead 5. Consequently, the mechanical pencil runs as smoothly and softly on paper as a gold pen does.

When the lead is exhausted during writing, the lead cartridge 6 is held at the rear projection 6*b* and is drawn off from the lead guide 4. Then, a new lead cartridge 6 containing a plurality of leads is pushed into the outer cylinder 1 so that the lead cartridge 6 is fitted in the lead guide 4. Since the outside diameter of the lead cartridge 6 is approximately the same as the inside diameter of the outer cylinder 1 and the inside diameter of the lead guide 4, even if there are residual leads 5 in the lead guide 4, those residual leads 5 are received smoothly into the new lead cartridge 6 without interfering with the new lead cartridge. Particularly, when the taper part 6*a* is formed in the inside surface of the front end of the lead cartridge 6, the residual leads 5 are guided into the new lead cartridge smoothly even if those residual leads 5 are inclined in the outer cylinder 1. Besides, since the lead cartridge 6 functions both as a lead container and as a lead pipe when the lead cartridge 6 is fitted in the lead guide 4, the construction of the mechanical pencil is simplified remarkably.

Figure 13:
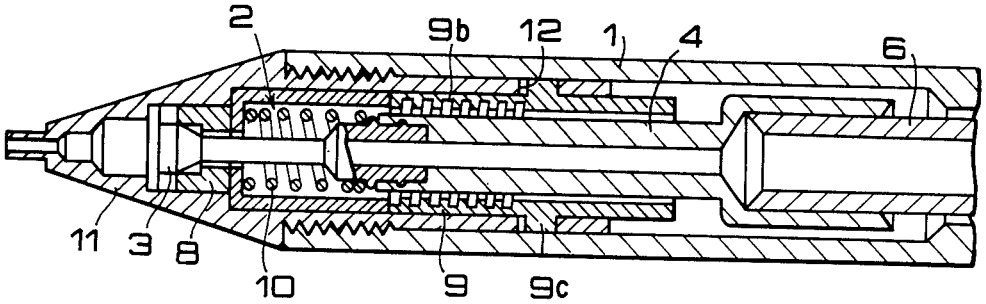
FIG. 13 is a longitudinal sectional view of a third embodiment of the present invention.

FIG. 13 shows a further embodiment of the present invention, in which the position of the cushion sleeve 9 in the tip member 11 is adjustable.

The tip member 11 housing a lead feeding mechanism 2 is joined to the front end of an outer cylinder 1 by screwing or by press-fit. One or a plurality of connecting slots 12 are formed in the circumference of the rear part of the tip member 11.

Figure 14:
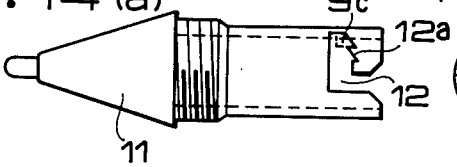
FIGS. 14(*a*), 15(*a*), 16(*a*), 17(*a*) and 18(*a*) are front elevations of tip members.
Figure 14:
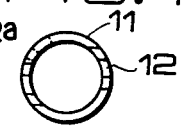

As shown in FIGS. 14(*a*) (front elevation) and 14 (*b*) (side elevation), the connecting slots 12 are arranged oppositely on the circumference of the tip member 11 and each connecting slot 12 is provided with sawtooth steps 12*a* for adjusting the disposition of the cushion sleeve 6. The cushion sleeve 9 is fitted on the rear end of the tip member 11 with the stopping projections 9*c* engaging the connecting slots 12. The connecting slot 12 provides the same effect as provided by the first embodiment and, in addition, the sawtooth steps 12*a* make possible the adjustment of the disposition of the cushion sleeve 9 relative to the tip member 11 so that an optional writing pressure absorbing effect is obtained.

The cushioning part 9*b* of the cushion sleeve 9 may be of any construction and any form as those shown in FIGS. 5 to 8, provided that the cushioning part 9*b* is capable of being deformed effectively.

Figure 15:
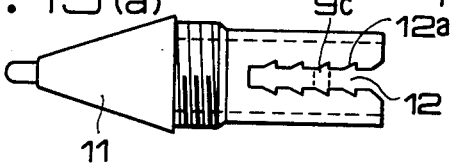
Figure 15:
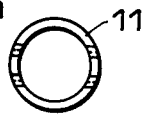
Figure 16:
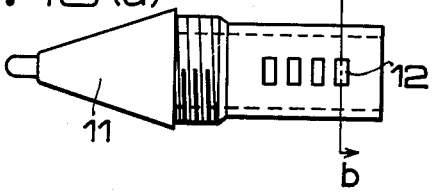
Figure 16:
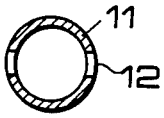

The connecting slot 12 of the tip member 11 may be of forms as shown in FIGS. 15 to 17 which engage the stopping projection 9*c* of the cushion sleeve 9 or of a form into which a cushion sleeve 9 having no stopping projection 9*c* is fit closely by press fit.

FIG. 19 shows improvements in the second embodiment (FIGS. 13 to 18) of the present invention. In this embodiment, the functions of the cushion sleeve 9 are allotted to two functional parts, i.e., a sleeve 13 and a cushioning and stopping member 14.

As shown in FIG. 20, the cushioning and stopping member 14 is provided, in the fron portion thereof, with a cushioning part 14*a* and, on the circumferential wall thereof, with a pair of stopping projections 14*b* which engage the connecting slots 12 of the tip member 11. The disposition of the cushioning and stopping member 14 relative to the tip member 11 is adjustable.

The cushioning part 14*a* of the cushioning and stopping member 14 may be formed, for example, as shown in FIGS. 21 to 27, while the connecting slots 12 may be formed, for example, as shown in FIGS. 14 to 18.

Figure 28:
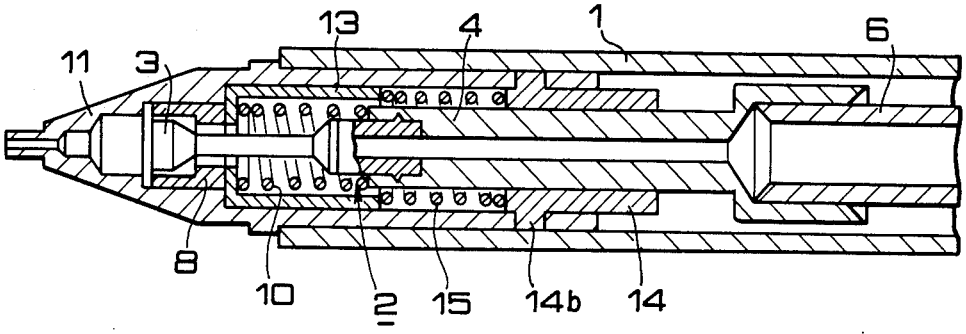

In an embodiment shown in FIG. 28, the functions of the cushion sleeve 9 are allotted to a stopper 14 and an elastic member 15. The stopper 14 is fitted in the tip member 11 to provide the same effect as described above.

Figure 29:
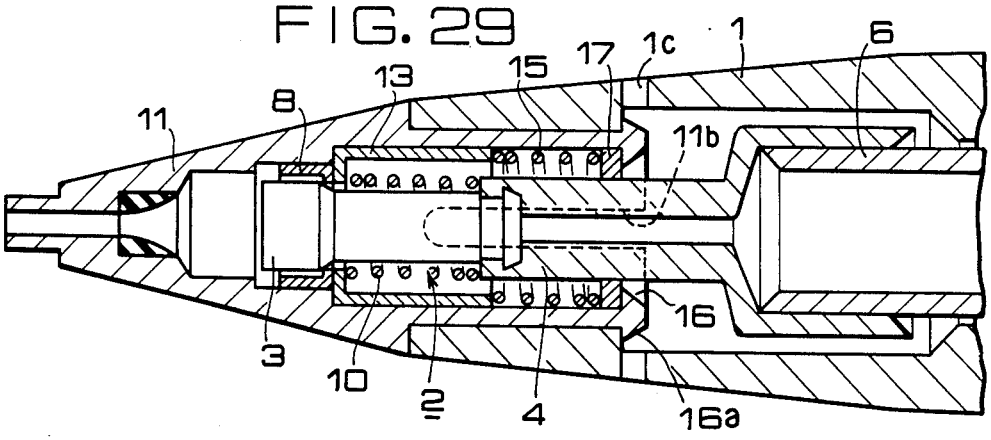
FIG. 29 is a longitudinal sectional view of a fifth embodiment of the present invention.
Figure 30:
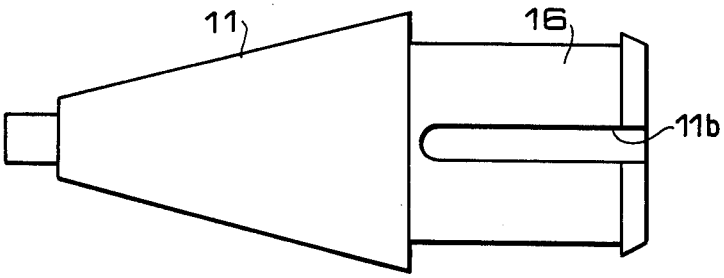
FIG. 30 is a front elevation of a tip member.

Shown in FIG. 29 is a cartridge type mechanical pencil, in which a lead feeding mechanism 2 is fitted in a tip member 11 to facilitate assembling. In this embodiment, a slit 11*b* is formed in the tip member 11 as shown in FIG. 30 so that the rear portion of the tip member 11 is diametrically expandable to facilitate fitting the lead feeding mechanism 2 in the tip member 11 and to facilitate and ensure the engagement of stop holes 1*c* formed in the outer cylinder 1 and a engaging protrusion 16. A stop ring 17 is disposed, in contact with the rear end of an elastic member 15 to restrict the rearward movement of the elastic member 15 and to guide the lead cartridge 6.

Figure 31:
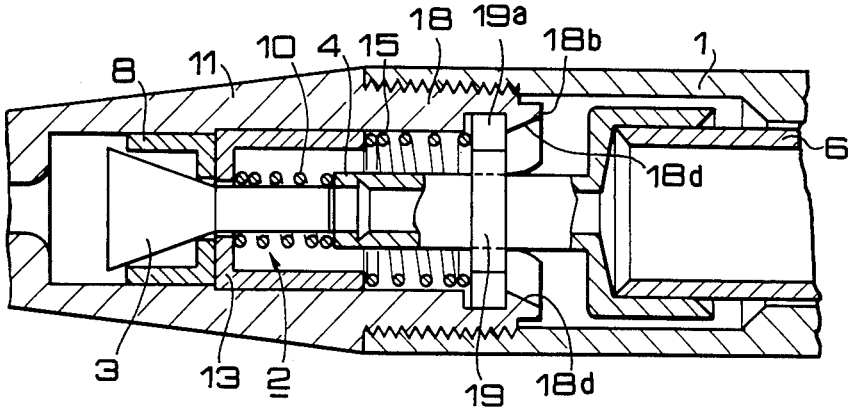
FIG. 31 is a longitudinal sectional view of a sixth embodiment of the present invention.

Shown in FIG. 31 also is a cartridge type mechanical pencil embodying the present invention. This mechanical pencil also can be assembled by assembling a tip member 11 and a lead feeding mechanism 2 first, and then attaching the tip member 11 to an outer cylinder 1.

Figure 32:
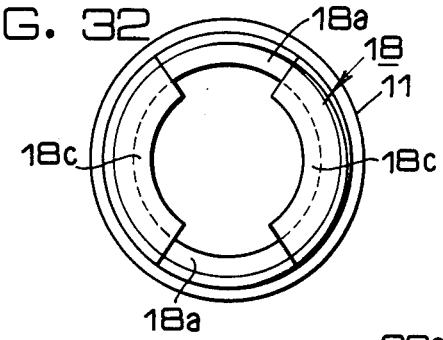
FIG. 32 is a side elevation of a tip member.

As shown in FIG. 32, a plurality of recesses 18*a* are formed in the rear end of the engaging part 18 of the tip member 11. Protruding parts 18*b* are formed between the recesses 18*a*. Radial catches 18*c* each having an inclined outer face are formed inside the protruding parts 18*b*.

Figure 33:
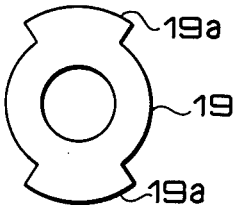
FIG. 33 is a side elevation of a stop ring.

As shown in FIG. 33, a stop ring 19 is provided with protrusions 19*a* of a diameter approximately the same as the inside diameter of the engaging part 18. The width of each protrusion 19*a* is somewhat smaller than that of the recess 18*a*. The stop ring 19 is fitted in the engaging part 18 by passing the protrusions 19*a* through the recesses 18*a*, and then the stop ring 19 is turned through an angle in a clockwise direction or in a counterclockwise direction so that the protrusions 19*a* are caught by the radial catches 18*c* of the engaging part 18 of the tip member 11. Part of the stop ring 19 other than the protrusions 19*a* is formed in a circle of a diameter smaller than a diameter of a circle defining the inner edges of the catches 18*c* so that the stop ring 19 can be fitted into the engaging part 18 through the catches 18*c* by press fit. The inside diameter of the stop ring 19 is designed so that stable lead feeding motion, namely, axial sliding motion, of the lead guide 4 is possible.

Figure 34:
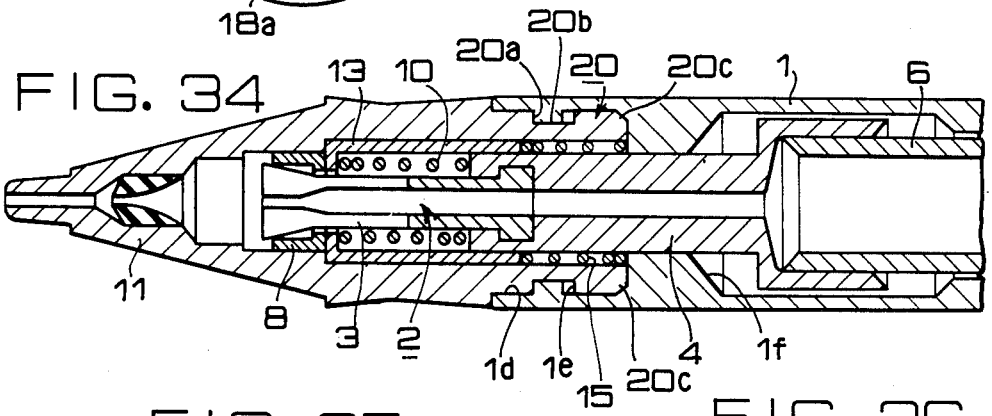
FIG. 34 is a longitudinal sectional view of a seventh embodiment of the present invention.

Shown in FIG. 34 is a cartridge type mechanical pencil embodying the present invention. In this embodiment, the tip member 11 is capable of containing a lead feeding mechanism 2 and need not any particular machining, and hence the mechanical pencil can be produced at a reduced cost.

Figure 35:
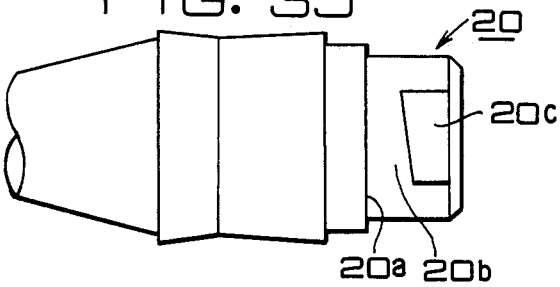
FIG. 35 is a front elevation of a tip member.

The tip member 11 of this embodiment is formed of a synthetic resin by molding in a single unit. The rear portion of the tip member 11 is reduced in diameter to form an engaging cylindrical part 20. As shown in FIGS. 34 and 35, a shoulder 20*a* is formed in the engaging cylindrical part 20. A pair of catching protrusions 20*c* are formed on the outer surface of the engaging cylindrical part 20, for example, at diametrically opposite positions so that grooves 20*b* are formed between the shoulder 20*a* and the catching protrusions 20*c*. The front face of each catching protrusion 20*c* is tapered.

Figure 36:
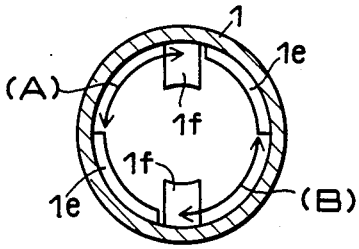
FIG. 36 is a side elevation of an outer cylinder.

An outer cylinder 1 formed of a synthetic resin by molding is provided in the front end thereof with a socket 1*d*, As shown in FIG. 36, radial projections 1*e* are formed on the inner surface of the socket 1*d* at diametrically opposite positions. The rear face of each radial protrusions 1*e* is tapered along the circumferential direction at a predetermined angle. Stopping parts 1*f* are formed in the outer cylinder 1 so as to be in abutment with the rear ends of the catching protrusions 20*c*. The engaging cylindrical part 20 of the tip member 11 is designed so as to be fitted in the socket 1*d* of the outer cylinder 1. As shown in FIG. 34, when the engaging cylindrical part 20 is fitted in the socket 1*d*, the radial protrusions 1*e* fit in the grooves 20*b* and are pressed against the catching protrusions 20*c* by the agency of the cushioning elastic member 15, and thereby the tip member 11 and the outer cylinder 1 are connected unseparably.

The tip member 11 and the outer cylinder 1 are connected in the following procedure. First the tip member 11 is placed opposite the socket 1*d* of the outer cylinder 1 with the catching protrusions 20*c* located opposite portions A and B indicated in FIG. 36, and then, the engaging cylindrical part 20 of the tip member 11 is inserted firmly into the socket 1*d*. Then, the tip member 11 is turned, for example, in a clockwise direction to engage the taper faces of the catching protrusions 20*c* and the taper faces of the radial protrusions 1*e*. Thus the tip member 11 and the outer cylinder 1 are connected firmly by the resilient force of the cushioning elastic member 15.

The constitution of this embodiment provides the same effect as that of the previous embodiments and eliminates any particular machining of the tip member 11, so that a cartridge type mechanical pencil of a reduced cost is provided.

Figure 37:
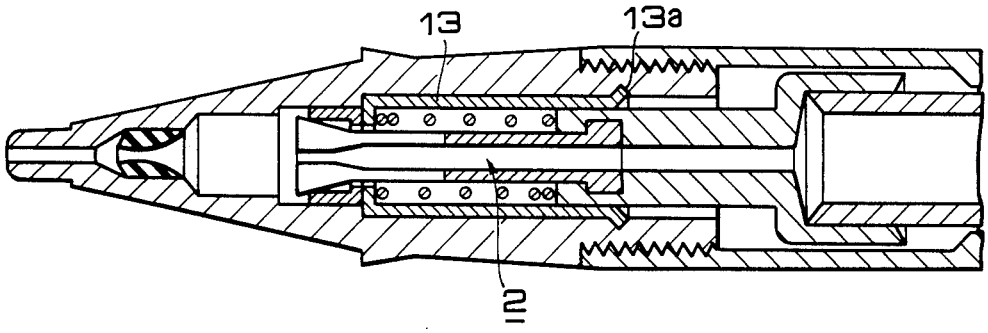
FIGS. 37 and 38 are longitudinal sectional views of eighth and ninth embodiments of the present invention.
Figure 38:
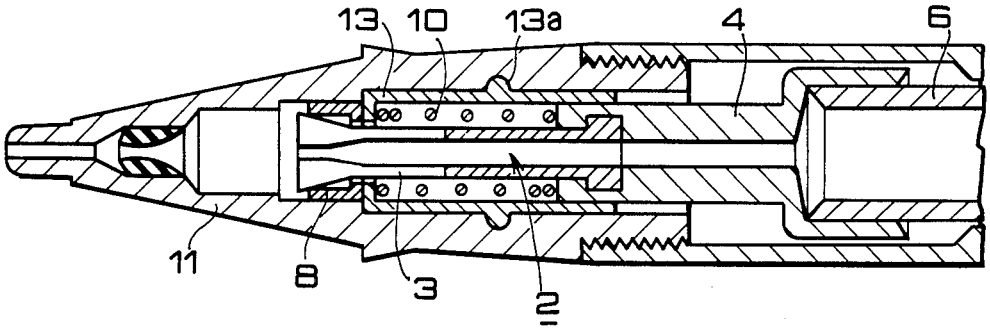

Shown in FIGS. 37 and 38 are cartridge type mechanical pencil embodying the present invention. This mechanical pencil has a tip member 11 having a sleeve 13 attached to the inner wall thereof.

A gripping protrusion 13*a* such as a flange which grips the inner wall of the tip member 11 is formed in the sleeve 13. The sleeve 13 is attached directly to the inner wall of the tip member 11.

Accordingly, the constitution of this embodiment provides the same effect as that of the previous embodiments, simplifies the form of the outer cylinder and reduces the cost of the mechanical pencil.

Thus, according to the present invention, the cushion sleeve improves the assembling efficiency remarkably, while the number of the component parts is reduced, and thereby the manufacturing cost of the mechanical pencil is reduced remarkably.

Furthermore, the mechanical pencil is replenished with leads simply by replacing the lead cartridge with a new one instead of supplying leads one by one, and hence the hands will not be soiled. Still further, even if some leads remain in the outer cylinder when a new lead cartridge is supplied, those residual leads are neither broken nor interfere with the cartridge and are received smoothly in the new cartridge. Thus the mechanical pencil according to the present invention is simple in construction and facilitates the replacement of the cartridge.

Furthermore, since the lead feeding mechanism and the associated parts are constructed in the tip member, the assembling work is simplified and is performed efficiently and the cost of the mechanical pencil is reduced.

What is claimed is:

1. A mechanical pencil comprising:

(a) an outer cylinder;

(b) a lead feeding mechanism axially slidably fitted in said outer cylinder;

(c) a lead chuck provided at the front end of said lead feeding mechanism;

(d) a lead guide which includes a rear edge tapered at the inner periphery thereof and which is coupled to said lead chuck of said lead feeding mechanism;

(e) a lead cartridge which includes a front edge tapered at the inner periphery thereof and is detachably fitted into a cartridge receiving bore in said lead guide;

(f) a chuck fastening pipe for fastening said lead chuck;

(g) a tip member connected to the front end of said outer cylinder;

(h) a cushion sleeve disposed in contact with said chuck fastening pipe to regulate the retracting movement of the chuck fastening pipe, said cushion sleeve having integrally formed therewith an elastically deformable cushioning part for regulating writing pressure; and (i) said cushioning part being retained by said tip member which is attached to said outer cylinder and which tip member is provided with a threaded part to facilitate attachment of said tip member to said outer cylinder.

* * * * *